US008555601B2

(12) United States Patent
Brunner

(10) Patent No.: US 8,555,601 B2
(45) Date of Patent: Oct. 15, 2013

(54) TIMBER SUPPORT FOR THE CONSTRUCTION INDUSTRY

(75) Inventor: Werner Brunner, Buch (DE)

(73) Assignee: Peri GmbH, Weissenhorn (DE)

( * ) Notice: Subject to any disclaimer, the term of this patent is extended or adjusted under 35 U.S.C. 154(b) by 0 days.

(21) Appl. No.: 12/998,744

(22) PCT Filed: Nov. 23, 2009

(86) PCT No.: PCT/DE2009/001665
§ 371 (c)(1),
(2), (4) Date: May 26, 2011

(87) PCT Pub. No.: WO2010/063257
PCT Pub. Date: Jun. 10, 2010

(65) Prior Publication Data

US 2011/0219726 A1 Sep. 15, 2011

(30) Foreign Application Priority Data

Dec. 1, 2008 (DE) ..... 10 2008 059 817

(51) Int. Cl.
*E04C 3/00* (2006.01)

(52) U.S. Cl.
USPC ..... 52/837; 52/650.1

(58) Field of Classification Search
USPC ..... 52/837, FOR. 121, FOR. 124, FOR. 156, 52/650.1, 831, 36, 838
See application file for complete search history.

(56) References Cited

U.S. PATENT DOCUMENTS

| | | | | | |
|---|---|---|---|---|---|
| 183,160 | A * | 10/1876 | Haughian | 428/598 |
| 1,906,683 | A * | 5/1933 | Weiskopf et al. | 52/838 |
| 4,191,000 | A * | 3/1980 | Henderson | 52/837 |
| 4,195,462 | A * | 4/1980 | Keller et al. | 52/690 |
| 4,413,459 | A * | 11/1983 | Lambuth | 52/837 |
| 4,456,497 | A * | 6/1984 | Eberle | 156/257 |
| 4,937,998 | A * | 7/1990 | Goldberg | 52/842 |
| 5,483,782 | A * | 1/1996 | Hall | 52/836 |
| 5,875,605 | A * | 3/1999 | Rudd | 52/847 |
| 5,974,760 | A * | 11/1999 | Tingley | 52/837 |
| 5,996,305 | A * | 12/1999 | Holbert et al. | 52/745.19 |
| 6,012,262 | A * | 1/2000 | Irving | 52/837 |
| 6,167,675 | B1 * | 1/2001 | LeBlanc | 52/847 |
| 6,173,550 | B1 * | 1/2001 | Tingley | 52/837 |
| 6,460,310 | B1 * | 10/2002 | Ford et al. | 52/837 |
| 6,701,690 | B2 * | 3/2004 | Deschenes | 52/837 |
| 8,065,848 | B2 * | 11/2011 | Carlson et al. | 52/309.16 |

(Continued)

FOREIGN PATENT DOCUMENTS

| | | |
|---|---|---|
| AT | 409 013 | 5/2002 |
| CN | 2 196 661 | 5/1995 |

(Continued)

*Primary Examiner* — William Gilbert
*Assistant Examiner* — James Ference
(74) *Attorney, Agent, or Firm* — Paul Vincent

(57) ABSTRACT

A timber support (1) for the construction industry, has a top girder (3) and a bottom girder (4) which are interconnected using a joining element (6). A protective cap (10) that surrounds the end (9) of the girder is provided for the end of the girders. The protective cap (10) for the end of the girders has at least one fastening bracket (15) which partially covers a side of the joining element (6), and the fastening bracket (15) for attaching the protective cap (10) for the end of the girders is fixed to the side of the joining element (6) with the help of fastening means.

12 Claims, 3 Drawing Sheets

(56) References Cited

U.S. PATENT DOCUMENTS

| | | | | |
|---|---|---|---|---|
| 2002/0166306 | A1* | 11/2002 | Wilson | 52/729.1 |
| 2003/0014938 | A1* | 1/2003 | Deschenes | 52/729.2 |
| 2006/0032182 | A1* | 2/2006 | Carlson et al. | 52/729.1 |
| 2006/0070339 | A1* | 4/2006 | Peneder | 52/729.1 |
| 2007/0137137 | A1* | 6/2007 | Peek et al. | 52/729.1 |
| 2007/0256389 | A1* | 11/2007 | Davis | 52/729.4 |

FOREIGN PATENT DOCUMENTS

| | | |
|---|---|---|
| CN | 2 876 221 | 3/2007 |
| CN | 2010 80 670 | 7/2008 |
| DE | 72 40 306 | 2/1973 |
| DE | 4 304 438 | 8/1994 |
| DE | 103 05 613 | 9/2004 |
| DE | 10 2007 002 256 | 8/2008 |
| GB | 2 415 206 | 12/2005 |

* cited by examiner

TIMBER SUPPORT FOR THE CONSTRUCTION INDUSTRY

This application is the national stage of PCT/DE2009/001665 filed on Nov. 23, 2009 and also claims Paris Convention priority of DE 10 2008 059 817.8 filed on Dec. 01, 2008.

BACKGROUND OF THE INVENTION

The invention concerns a timber support for the construction industry, comprising a top girder and a bottom girder which are interconnected using a joining element, wherein a girder end protection cap is provided, which surrounds the end of the girder. Timber supports of this type are used e.g. as supports for a framework for concrete structures to be cast, in particular, for concrete ceilings and walls.

Timber supports of this type are disclosed e.g. in the documents AT 409 013 B or DE 103 05 613 A1. The joining element or its parts are normally glued to the girders via tongue and groove connections. The girders are thereby produced from natural wood.

Timber supports of this type have the problem that, in particular, in case of improper handling at the building site, the ends of the girders may be easily damaged. The ends are likely to be abraded when the timber support is dragged along e.g. a concrete surface during transport thereof. However, the main cause of damage are impacts onto the girder ends, e.g. when the timber support is dropped, in which case the girder ends may be chipped. AT 409 013 B proposes protective caps for the girder ends which are pushed onto the girder ends and fastened thereto using hollow rivets. This type of fastening damages the wood of the girder itself, which increases its tendency to chip when the girder end is struck.

The girder ends of document DE 103 05 613 A1 are protected by a plastic cover that is e.g. cast or overmolded, thereby preventing the above-mentioned material weakening of the girder wood. However, these caps or plastic covers that are used as girder end protection have the problem that plastic material is subjected to ageing processes which make it brittle. Plastic material becomes brittle e.g. through the action of the ultraviolet radiation of sunlight. In particular, when a timber support falls onto a plastic cap of this type, the protection often does not withstand the resulting high load and the cap bursts with the result that the associated girder end is no longer protected.

It is the underlying purpose of the invention to provide a timber support for the construction industry, which eliminates the disadvantages of prior art, in particular, reliably prevents chipping of the timber support girder ends using simple means.

This object is achieved by the timber support in accordance with the independent claim. The dependent claims are preferred embodiments of the invention.

SUMMARY OF THE INVENTION

The timber support for the construction industry in accordance with the invention has a top girder and a bottom girder which are interconnected using a joining element. At least one girder end of the girders, or all four girder ends, may thereby project past the joining element in the longitudinal direction of the timber support. Each girder end has one girder end protection cap that covers the girder end. In accordance with the invention, the girder end protection cap(s) each has/have at least one fastening bracket which partially covers a side flank of the joining element, wherein the fastening bracket for fastening the respective girder end protection cap is fastened to the side flank using fastening means.

Since the girder end protection caps are fastened to a side flank of the joining element, i.e. to an outer surface of the joining element, which extends parallel to the longitudinal direction of the timber support, fastening to the girders is not necessary, which would weaken the structure of the natural wood of the girders. The impact resistance of the girders, in particular, in case of impacts onto the girder ends that are covered by the girder end protection caps is thereby considerably improved. The material of the girder end protection caps may thereby be selected in the form of a material that cannot be applied e.g. by overmolding. The girder end protection caps may be prefabricated. A material may be used which is highly resistant to embrittlement and is, in particular, resistant to UV light.

The girder end protection caps are preferably produced from a metal material (e.g. galvanized sheet metal), which is a particularly low-wear material that is resistant to impact.

The fastening bracket of a girder end protection cap of this type preferentially has a bore, wherein a bolt, preferably in the form of a riveting bolt which penetrates through the bore, or a screw which penetrates through the bore, is provided as fastening means. The riveting bolt or the screw may be reliably screwed into or penetrate through the material of the joining element for fastening. This ensures particularly reliable fastening, in particular against tensile forces.

When the girder end protection cap has two fastening brackets which each partially cover a side flank of the joining element and each have one bore, and the screw or the bolt penetrates through both bores, the screw or the bolt which penetrates through a hole in the joining element may be symmetrically fixed to both side flanks of the joining element.

The joining element is advantageously designed as a solid web, which largely prevents tearing off of the fastening means from the side flanks of the joining element, since the fastening brackets flatly abut the side flanks.

When the girder end covered by the girder end protection cap is formed to taper towards its free end, chipping protection is particularly improved in that impact forces are laterally deflected.

A step is preferably formed on the surface of the girder, the girder end of which is covered by the girder end protection cap, such that the material of the girder end protection cap does not project past the side surface of the girders. This prevents the girder end protection cap from getting hooked during movement of the timber support in the longitudinal direction of the timber support. The girder end protection cap may also terminate upstream of the wooden step. This generates a gap which is closed to a greater or lesser degree when the cap is subjected to impact loads.

The step is preferentially formed at least on the surface of the girder facing away from the joining element, wherein the step height corresponds to the thickness of the material from which the girder end protection cap is produced. This provides a flat support surface, e.g. for formwork boards, on the surface of the girder facing away from the joining element.

Recessing of the outer surface of the girder end protection cap from the outer dimensions of the girder on the side flank side, the girder end of which is covered by the girder end protection cap, prevents the inventive timber supports from getting hooked together during lateral stacking e.g. for transport purposes.

The girder end protection cap advantageously has at least one drainage opening, wherein the drainage opening is advantageously provided at the front end of the girder end protection cap. This prevents water that enters into the girder end protection cap from collecting there and excessively swelling the girder end covered by the girder end protection cap. The service life of a girder end protected with a girder end protection cap of this type is thereby substantially increased.

The invention is explained in more detail below by means of embodiments with reference to the drawing.

DESCRIPTION OF THE PREFERRED EMBODIMENT

Figure 1:
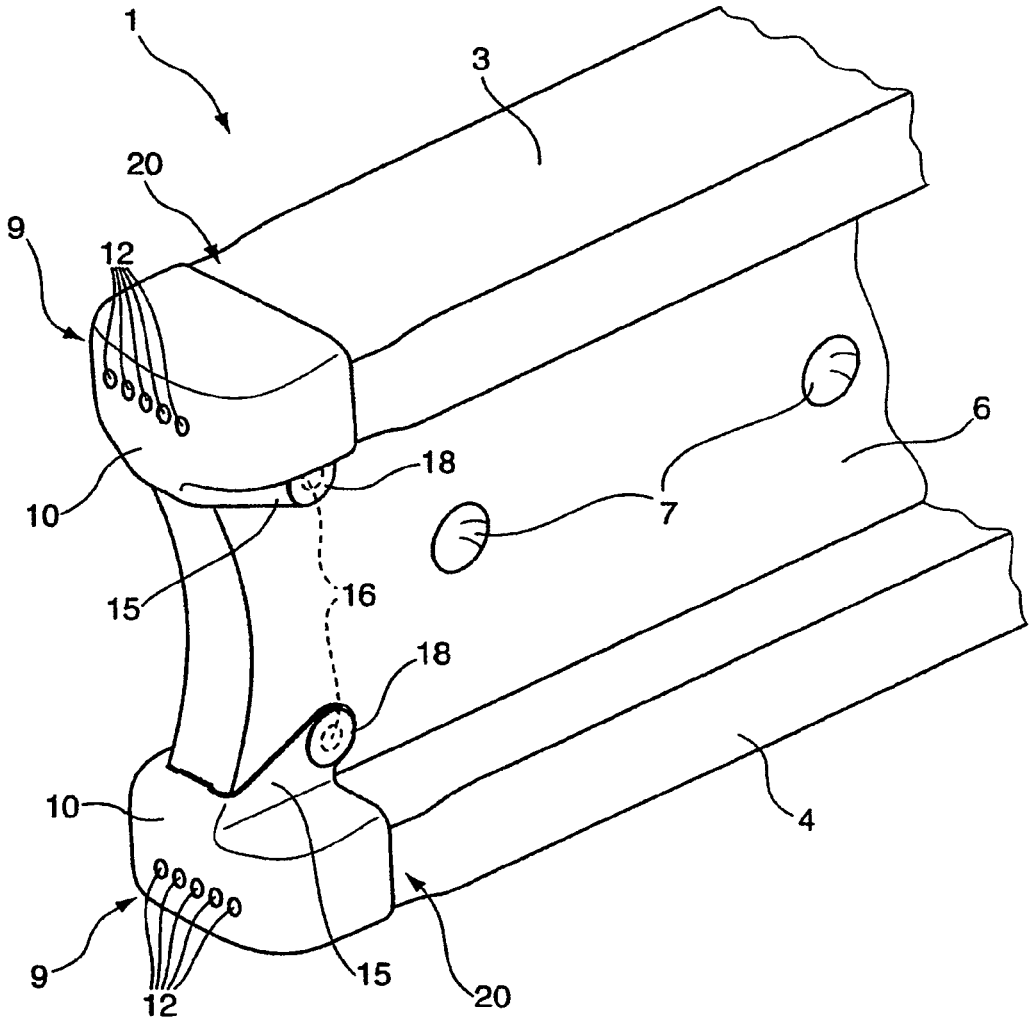
FIG. 1 shows a perspective view of a section of an inventive timber support.

The figures of the drawing show the inventive subject matter in a highly schematic fashion and are not to be taken to scale. The individual components of the inventive subject matter are illustrated in such a fashion that their structure is clearly shown.

FIG. 1 shows a perspective view of a section of an inventive timber support 1. The timber support 1 has a top girder 3 and a bottom girder 4 which are rigidly interconnected by a joining element designed as a solid web 6 with bores 7, which may e.g. be used for fastening to a hook of a crane. The girders 3, 4 are produced e.g. from natural wood and the solid web 6 may be produced from a plywood material or a suitable chipboard. The girder ends 9 of the girders 3, 4 project in the longitudinal direction of the timber support 1 past the joining element with respect to the center longitudinal axis of the joining element.

Each girder end 9 of the timber support 1 has a girder end protection cap 10 of steel which covers the girder end 9. The front ends of the girder end protection caps 10 each have several bores that penetrate through the material of the girder end protection caps 10 and are used as drainage openings 12.

Each girder end protection cap 10 has two fastening brackets 15 which are disposed mirror-symmetrically with respect to the solid web 6 and each partially cover a side flank of the joining element. Due to the perspective illustration of the figure, only the fastening brackets 15 on one side of the timber support 1 are shown. The fastening brackets 15 are produced in one piece with the girder end protection cap 10 from the material of the associated girder end protection cap 10 and each have a bore 16. The bores 16 are illustrated by the dashed circles. One riveting bolt 18 that penetrates through the solid web is guided through each bore 16. The riveted ends of the riveting bolts 18 cover the bores 16 in the fastening brackets 15 in the figure. These riveting bolts 18 are used as fastening means for fastening the girder end protection caps 10 to the side flanks of the solid web 6.

The girder ends 9 that are covered by the girder end protection caps 10 are e.g. formed through milling in such a fashion that they taper towards their free ends. A step 20 is thereby formed on the surface of each girder. These steps 20 each form a transition between the girder surface areas covered by the girder end protection caps 10 and surface areas that are not covered.

The steps are also formed, in particular, on surfaces of the girders facing away from the joining element. The step height on these surfaces corresponds to the thickness of the material from which the girder end protection caps 10 are produced such that there is substantially no edge at the transitions between the covered girder area and the surface of the girder end protection caps 10. Each outer surface of the girder end protection cap 10 is recessed from the outer dimensions of the girders 3, 4 on the side flank side such that the girder end protection caps 10 do not laterally project past the dimensions of the girders 3, 4.

FIGS. 2*a* through 2*f* show partial views and sectional views of a timber support in accordance with FIG. 1. The figures each show at least one girder end protection cap 10 which covers a girder end 9 of a girder 3, 4. The girders 3, 4 are interconnected via a solid web 6 as joining element.

Figure 2A:
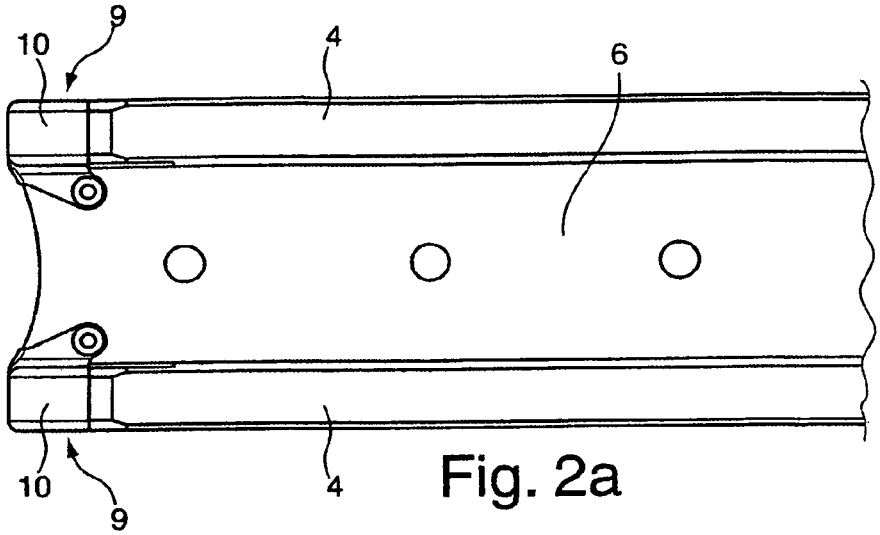
FIGS. 2*a* through 2*f* show partial views and sectional views of a timber support in accordance with FIG. 1.
Figure 2B:
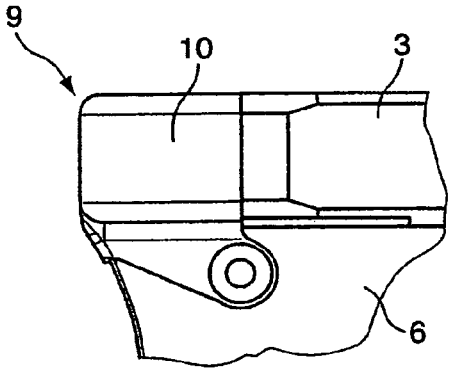

FIG. 2*a* shows a side view of an end of the timber support. FIG. 2*b* shows an enlarged section of FIG. 2*a*, wherein the section shows a girder end 9 with a girder end protection cap 10 covering the girder end 9.

Figure 2C:
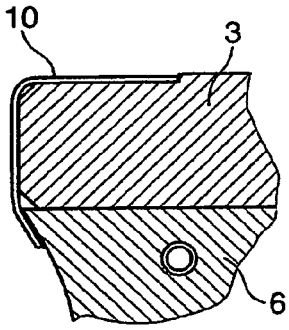
Figure 2D:
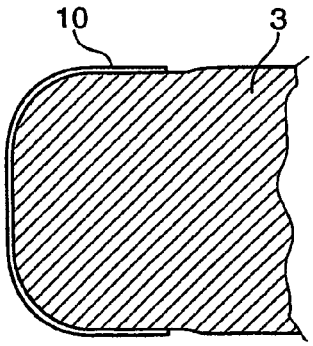
Figure 2E:
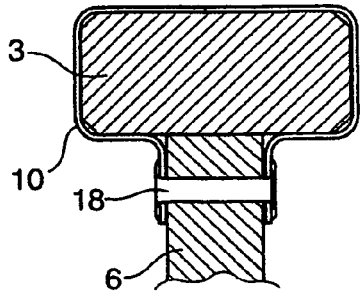

FIG. 2*c* is a longitudinal section through the girder end illustrated in FIG. 2*b*, which shows the material boundary between girder 3 and solid web 6. The timber support in accordance with the invention is produced in that the girder ends that project past the solid web 6 are formed through cutting using saws and/or milling machines, and for this reason, there is a hollow space between the girder end, the solid web and the girder end protection cap 10. FIG. 2*d* shows a sectional view through the girder end at the height of the girder 3. It shows how the girder end is covered by the metal of the girder end protection cap 10 with exact fit. FIG. 2*e* shows a cross-section through the girder end at the height of the fastening bolt 18 which penetrates through the holes in the fastening brackets of the girder end protection cap 10 and through the solid web 6.

Figure 2F:
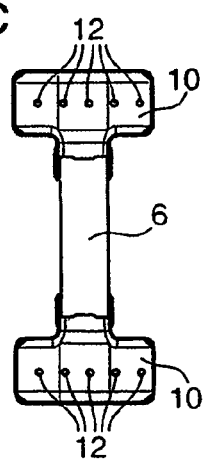

FIG. 2*f* shows a plan view of the front end of the timber support with the drainage openings 12 provided in the front ends of the girder end protection caps 10.

The invention proposes a timber support 1 for the construction industry, comprising a top girder 3 and a bottom girder 4 which are interconnected using a joining element 6, and wherein a girder end protection cap 10 is provided which covers the girder end 9. The girder end protection cap 10 thereby has at least one fastening bracket 15 that partially covers a side flank of the joining element 6, and the fastening bracket 15 for fastening the girder end protection cap 10 is mounted to the side flank using fastening means.

The invention is not limited to the above stated embodiments. Rather, a number of variants are feasible which, although they may have a basically different design, utilize the features of the invention.

Figure 3:
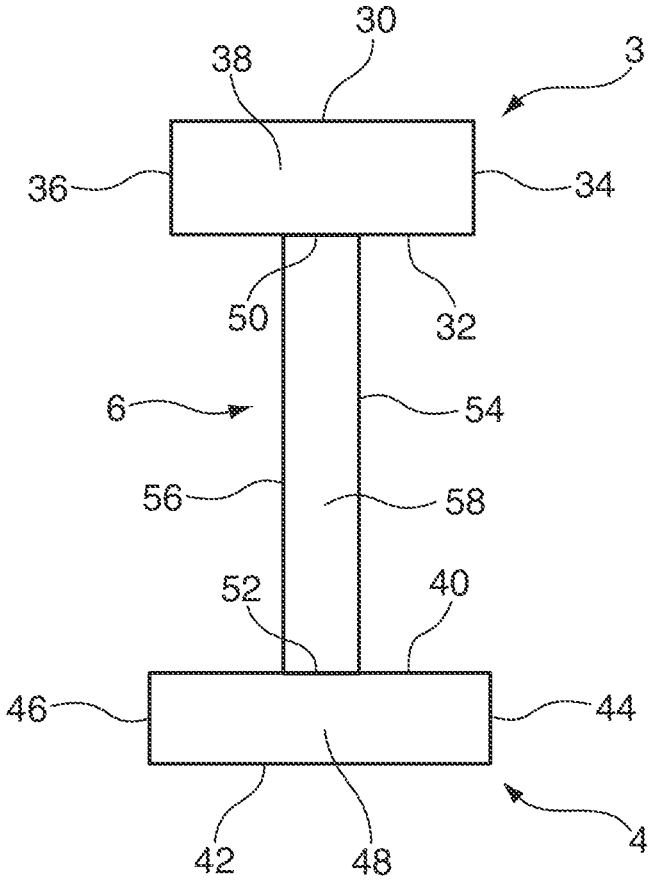
FIG. 3 shows a schematic front or end view of the timber support in accordance with the invention.

FIG. 3 is a schematic front or end view of the wooden portion of the timber support in accordance with the invention, without the girder end protection cap. The timber support has a wooden top girder 3, the top girder 3 having an upper surface 30, a lower surface 32, a first side flank 34, a second side flank 36 and a front surface 38. The timber support also has a wooden bottom girder 4, having an upper surface 40, a lower surface 42, a first side flank 44, a second side flank 46 and a front surface 48. A wooden joining element 6 has an upper surface 50 cooperating with said lower surface 32 of said top girder 3, a lower surface 52 cooperating with said upper surface 40 of said bottom girder 4, a first side flank 54, a second side flank 56 and a front surface 58. The first side flank 54, the second side flank 56 and the front surface 58 of the joining element 6 each extend from the lower surface 32 of the top girder 3 to the upper surface 40 of the bottom girder 4, such that the wooden joining element 6 is thereby disposed between and connects together the top girder 3 and the bottom girder 4.

I claim:

1. A timber support for the construction industry, the support comprising:

a wooden top girder, said top girder having an upper surface, a lower surface, a first side flank, a second side flank and a front surface;

a wooden bottom girder, said bottom girder having an upper surface, a lower surface, a first side flank, a second side flank and a front surface;

a wooden joining element, said joining element having an upper surface cooperating with said lower surface of said top girder, a lower surface cooperating with said upper surface of said bottom girder, a first side flank, a second side flank and a front surface, wherein said first side flank, said second side flank and said front surface of said joining element each extend from said lower surface of said top girder to said upper surface of said bottom girder, said wooden joining element thereby being disposed between and connecting together said top girder and said bottom girder, wherein said front surface of said top girder and said front surface of said bottom girder each protrude longitudinally past said front surface of said joining element;

a top girder end protection cap, said top girder end protection cap covering said front surface of said top and girder, said to girder end protection cap having at least one top fastening bracket that contacts and covers portions of at least one of said first and said second side flanks of said joining element, said top girder end protection cap further comprising top fastening means, said top fastening means directly connecting said to fastening bracket to at least one of said first and said second side flanks of said joining element; and a bottom girder end protection cap, said bottom girder end protection cap covering said front surface of said bottom girder, said bottom girder end protection cap having at least one bottom fastening bracket that contacts and covers portions of at least one of said first and said second side flanks of said joining element, said bottom girder end protection cap further comprising bottom fastening means. said bottom fastening means directly connecting said bottom fastening bracket to at least one of said first and said second side flanks of said joining element.

2. The timber support of claim 1, wherein each of said top and said bottom girder end protection caps is made from a metal material.

3. The timber support of claim 1, wherein each of said top and said bottom fastening brackets has a bore, with each of said to and said bottom fastening means comprising a bolt, a rivet bolt or a screw bolt penetrating through a respective said bore.

4. The timber support of claim 3, wherein each of said girder end protection caps has two fastening brackets which each partially cover a respective said first and said second side flank of said joining element and each having one bore, wherein a respective said screw or bolt penetrates through both said bores.

5. The timber support of claim 1, wherein said joining element is designed as a solid web.

6. The timber support of claim 1, wherein girder ends covered by a respective said top and said bottom girder end protection cap are designed to taper towards a respective free end thereof.

7. The timber support of claim 1, wherein a step Is formed on a surface of said top and/or said bottom girder, said step proximate said front surface of said top and/or said bottom girder covered by said respective top and bottom girder end protection cap.

8. The timber support of claim 7, wherein said step is formed on said upper surface of said top girder and/or said lower surface of said bottom girder, wherein a height of said step corresponds to a thickness of material from which a respective said top and said bottom girder end protection cap is produced.

9. The timber support of claim 1, wherein an outer surface of each of said top and said bottom girder end protection caps is recessed from outer dimensions of said first and second side flanks of said top or said bottom girder, said front surface of said top or said bottom girder being covered by said respective top and bottom girder end protection cap.

10. The timber support of claim 1, wherein each of said top and bottom girder end protection caps has at least one drainage opening.

11. The timer support of claim 10, wherein said drainage opening is provided on a front end of a respective said top and said bottom girder end protection cap.

12. A timber support for the construction industry, the support comprising:

a wooden top girder, said top girder having an upper surface, a lower surface, a first side flank, a second side flank and a front surface;

a wooden bottom girder, said bottom girder having an upper surface, a lower surface, a first side flank, a second side flank and a front surface;

a wooden joining element, said joining element having an upper surface cooperating with said lower surface of said top girder, a lower surface cooperating with said upper surface of said bottom girder, a first side flank, a second side flank and a front surface, wherein said first side flank, said second side flank and said front surface of said joining element each extend from said lower surface of said top girder to said upper surface of said bottom girder, said wooden joining element thereby being disposed between and connecting together said top girder and said bottom girder, wherein said front surface of said top girder and said front surface of said bottom girder each protrude longitudinally past said front surface of said joining element, said joining element also having a top through hole disposed proximate to said upper and said front joining element surfaces as well as a bottom through hole disposed proximate to said lower and said front joining element surfaces;

a top girder end protection cap, said top girder end protection cap covering said front surface of said top girder, said top girder end protection cap having two top fastening brackets which each partially cover a respective said first and said second side flank of said joining element and each having one top bore, said top girder end protection cap further comprising top fastening means directly connecting said top fastening bracket to said first and said second side flanks of said joining element, wherein said top fastening means comprise a top bolt, a top rivet bolt or a top screw bolt penetrating through both of said top bores and through said top through hole; and a bottom girder end protection cap, said bottom girder end protection cap covering said front surface of said bottom girder, said bottom girder end protection cap having two bottom fastening brackets which each partially cover a respective said first and said second side flank of said joining element and each having one bottom bore, said bottom girder end protection cap further comprising bottom fastening means directly connecting said bottom fastening bracket to said first and said second side flanks of said joining element, wherein said bottom fastening means comprise a bottom bolt, a bottom rivet bolt or a bottom screw bolt penetrating through both of said bottom bores and through said bottom through hole.

* * * * *